US007891225B2

(12) United States Patent
Hammerer et al.

(10) Patent No.: US 7,891,225 B2
(45) Date of Patent: Feb. 22, 2011

(54) BENDING MACHINE

(75) Inventors: Peter Hammerer, Bad Hindelang (DE); Bernd Eppler, Reutlingen (DE)

(73) Assignee: WAFIOS Aktiengesellschaft, Reutlingen (DE)

( * ) Notice: Subject to any disclaimer, the term of this patent is extended or adjusted under 35 U.S.C. 154(b) by 416 days.

(21) Appl. No.: 12/027,746

(22) Filed: Feb. 7, 2008

(65) Prior Publication Data

US 2008/0184761 A1 Aug. 7, 2008

(30) Foreign Application Priority Data

Feb. 7, 2007 (EP) ..... 07002654

(51) Int. Cl.

| | |
|---|---|
| ***B21D 11/00*** | (2006.01) |
| ***B21D 11/14*** | (2006.01) |
| ***B21D 43/10*** | (2006.01) |
| ***B21D 43/11*** | (2006.01) |

(52) U.S. Cl. ..... 72/306; 72/299; 72/311; 72/422

(58) Field of Classification Search ..... 72/299, 72/311, 301, 295–296, 308, 422, 306–307
See application file for complete search history.

(56) References Cited

U.S. PATENT DOCUMENTS

| | | | | |
|---|---|---|---|---|
| 4,211,123 | A | 7/1980 | Mack | |
| 4,348,044 | A | 9/1982 | Wood, III | |
| 4,381,169 | A | 4/1983 | Muhr et al. | |
| 4,604,885 | A * | 8/1986 | Lang | 72/306 |
| 4,735,075 | A * | 4/1988 | Saegusa | 72/306 |
| 4,945,747 | A | 8/1990 | Yogo | |
| 5,113,683 | A * | 5/1992 | Lafrasse | 72/306 |
| 5,291,771 | A | 3/1994 | Tomo et al. | |
| 5,566,565 | A | 10/1996 | Saegusa | |
| 5,765,426 | A | 6/1998 | Saegusa | |
| 5,852,945 | A | 12/1998 | Burger | |
| 5,873,278 | A * | 2/1999 | Saegusa | 72/306 |
| 6,694,794 | B2 | 2/2004 | Crippa | |
| 7,047,785 | B2 | 5/2006 | Peruzzo et al. | |
| 2003/0061853 | A1 | 4/2003 | Crippa | |
| 2003/0075941 | A1 | 4/2003 | McIntosh et al. | |

(Continued)

FOREIGN PATENT DOCUMENTS

| | | | |
|---|---|---|---|
| DE | 29 46 469 | A1 | 5/1981 |

(Continued)

*Primary Examiner*—Dana Ross
*Assistant Examiner*—Mohammad Yusuf
(74) *Attorney, Agent, or Firm*—Patterson Thuente Christensen Pedersen, P.A.

(57) ABSTRACT

A bending machine for bending elongated workpieces supplied from a magazine is disclosed. The bending machine comprises a base support; two bending robots arranged on a common guideway centrally mounted to the base support, such that the robots are displaceable parallel to the longitudinal direction of the base support. A holding clamp is positioned on the front face of the base support, with one auxiliary gripper on either side of the holding clamp. The holding clamp is displaceable in parallel with the bending robots. A discharge gripper is positioned on the rear surface of the base support, laterally offset with respect to the holding clamp.

All grippers and clamps are pivotable to an inner pivoting position, in which they can hold a workpiece in the working area of the bending machine between both bending robots; and to an outer pivoting position away from the base support.

16 Claims, 6 Drawing Sheets

U.S. PATENT DOCUMENTS

| | | | |
|---|---|---|---|
| 2004/0261485 | A1 | 12/2004 | Peruzzo et al. |
| 2005/0138983 | A1 | 6/2005 | Burger |
| 2008/0223101 | A1 | 9/2008 | Moeck et al. |

FOREIGN PATENT DOCUMENTS

| | | | |
|---|---|---|---|
| DE | 31 33 205 | A1 | 5/1982 |
| DE | 36 20 151 | A1 | 2/1987 |
| DE | 39 22 326 | C2 | 11/1990 |
| DE | 196 28 392 | A1 | 1/1997 |
| DE | 196 30 023 | A1 | 1/1998 |
| DE | 601 00 147 | T2 | 1/2004 |
| DE | 20 2004 011 947 | U1 | 9/2004 |
| DE | 10 2004 012 297 | A1 | 5/2005 |
| DE | 603 01 913 | T2 | 7/2006 |
| EP | 0 021 539 | A1 | 1/1981 |
| EP | 0 857 547 | A1 | 8/1998 |
| EP | 1 065 015 | A1 | 1/2001 |
| EP | 0 924 783 | B1 | 4/2003 |
| EP | 0 934 783 | B1 | 5/2006 |
| JP | 59-37083 | | 2/1984 |
| JP | 2-299723 | | 12/1990 |
| JP | 5-065440 | | 8/1993 |
| JP | 7-232219 | | 9/1995 |

* cited by examiner

Fig. 5
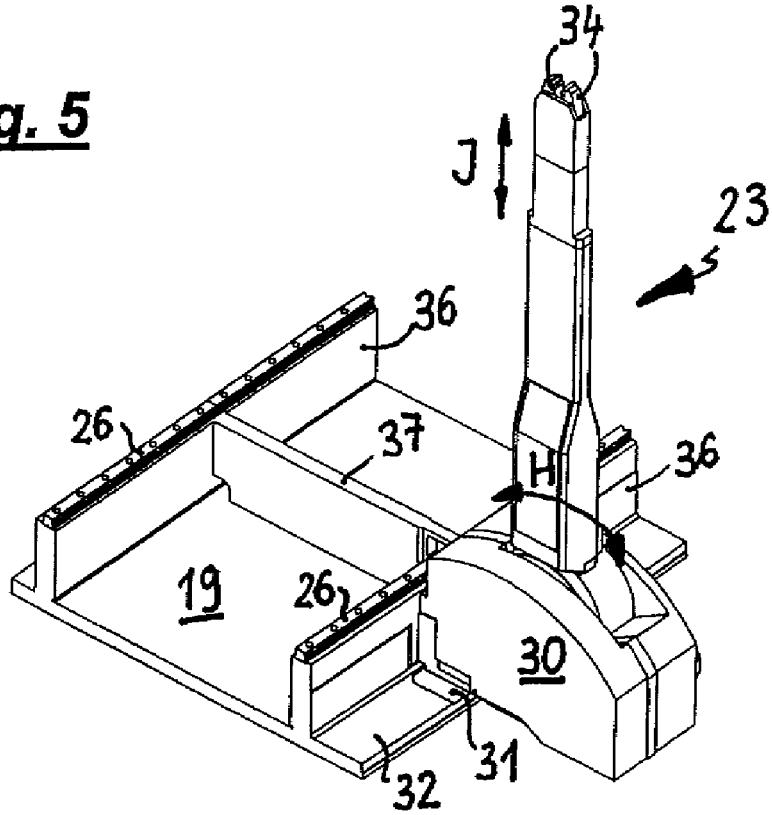
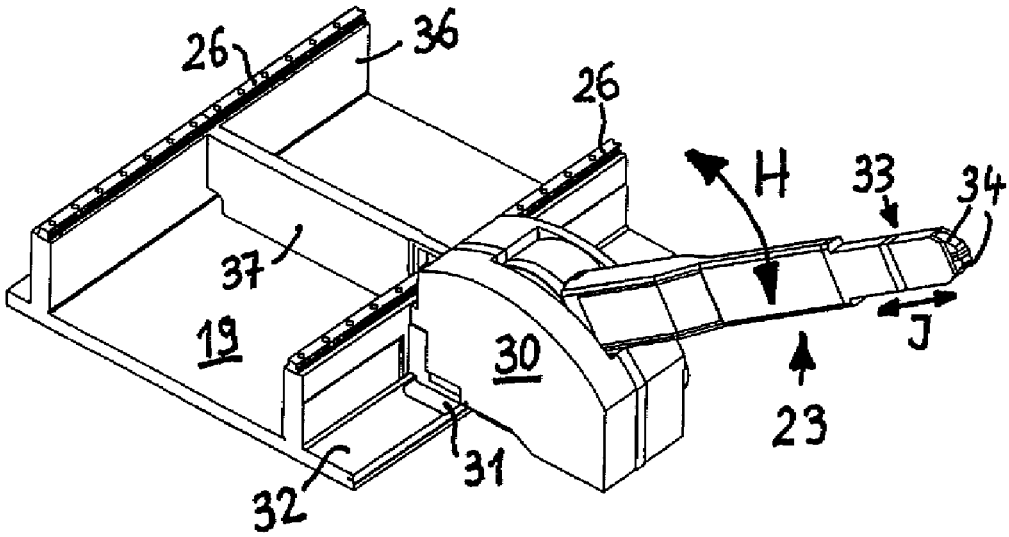
Fig. 6

BENDING MACHINE

RELATED APPLICATION

The current application claims the benefit of priority to European Patent Application No. 07 002 654.7 filed on Feb. 7, 2007. Said application is incorporated by reference herein.

FIELD OF THE DISCLOSURE

The invention relates to a bending machine comprising a working area for bending elongated workpieces, in particular wires, pipes, rods, or the like, which are supplied by a supplying means.

BACKGROUND OF THE INVENTION

Patent DE 3620151 A1 describes a bending device where two suspended articulated robots are employed, between which a rigidly and stationarily arranged clamping unit is provided, which enables rotation of the workpiece about the workpiece's longitudinal axis. In this case, the workpieces are picked up, either by means of a pivotable feeding unit or by the bending robots, from the conveyor belt of a supplying means and are transferred to the clamping unit. The workpiece can be deposited in a subsequently arranged receiving means after bending has been performed. In this disclosed bending machine, processing of a clamped elongated workpiece, e.g. of a pipe, is not possible at the clamping location due to the rigidly fixed clamping unit. Otherwise, the workpiece would have to be displaced in a longitudinal direction for this purpose, which involves a considerable complication. Moreover, the suspended arrangement of the articulated robots requires a relatively large support from which the articulated robots can be suspended. Finally, simultaneous insertion and deposition of workpieces is not possible with the bending machine disclosed in patent DE 3620151 A1. Also, additional securing or clamping of long workpieces is not provided therein.

The bending machine disclosed in DE 3922326 C2 as well as in EP 0 934 783 B1 is provided with two articulated robots, each of the robots arranged on its own guideway in a longitudinally displaceable manner. The guideways are parallel to each other and have arranged between them a gripping unit which can be vertically displaced and pivoted away downwardly. However, it is disadvantageous in the DE 3922326 C2 and EP 0 934 783 B1 bending machine that three separate guides are needed and the gripping unit is again stationary and not displaceable. Bending robots always have to be employed for handling the workpiece to be processed, which means a reduction in the performance of the entire machine. Moreover, stable securing of the workpieces, particularly of longer workpieces, cannot be ensured without additional gripping clamps. The bending heads on the bending robots likewise enable only the draw bending method.

DE 19628392 A1 describes a bending machine wherein two bending towers and a central gripping unit are mounted on a machine bed. The bending towers as well as the gripping unit can be moved on the machine bed. Bending heads, which are rotatable about the workpiece axis, are mounted to the bending towers. However, this disclosed bending machine only allows bending operations to be effected in the workpiece axis, which requires additional feed and pick-up units. Moreover, a great number of gear elements are needed to actuate the bending heads, and the gripping unit limits the free bending space in the working area of the machine.

The bending machine of DE 601 00 147 T2 uses two gripping units, which enables bending also of lines having a flexible portion. For this purpose, each gripping unit is provided with two grippers which can grip on both sides of a flexible part. The bending head is mounted to a kind of robot which may have very different designs. During operation, the first gripping unit takes the workpiece from a supplying unit and pivots it into the working area (bending area) of the bending machine. There, the first half of the workpiece is bent. The workpiece can then be rotated around 180° by the second gripping unit, after which the other half of the workpiece can then be provided with bends. Since, due to the presence of only one bending head, the two halves of the workpiece can only be bent one after the other, but not at the same time, this disclosed bending machine has relatively low performance. Moreover, the bending head employed enables only the draw bending method. In addition, the entire machine has a very complicated structure.

A handling means for rods in a bending system is disclosed in DE 603 01 913 T2. There, two grippers are mounted to a portal, on which they can be moved in space. Moreover, the grippers are pivotable about an axis which is parallel to the workpiece axis. Further, the bending heads are movably mounted on a guide bed. However, the portal construction of the transport means requires a large amount of space. Moreover, the grippers cannot be moved independently of each other to the supplying means (magazine), which in turn reduces the efficiency of the disclosed machine.

In the bending machine of DE 10 2004 012 297 A1, a multiplicity of bending stations are used in sequence, which are suspended from above, which require a relatively large support. In this case, several pivoting grippers are provided for transferring the workpieces between the individual bending stations, with the gripping mechanism tracing a curved path so as to pick up the pipe from the previous station and to pass it on to the subsequent station after bending. In addition to the large support, the bending machine also has the disadvantage that no additional support of the workpiece is provided apart from the respectively employed pivoting gripper.

Finally, a bending machine for processing workpieces in several stations is disclosed in DE 20 2004 011 947 U1, wherein each station comprises a central gripping unit and two bending heads arranged laterally of said gripping unit. The bending heads and the gripping unit are each displaceable on a common guide bed. Additionally, a pivotable transfer device is also provided by which each workpiece can be pivoted from the first station to the second parallel station. This transfer device can simultaneously also constitute the gripping unit. The machine works serially from out of a magazine. Due to the almost closed, round bending head disk of the disclosed bending machine, however, bends of more than 90° are not possible, and in some cases a cantilever is even used as the bending tool. This produces long, straight portions in the middle of a workpiece. The employed bending head only enables roll bending.

SUMMARY

In view thereof, the instant application discloses a bending machine, which is suitable particularly for bending elongated workpieces and, while exhibiting great efficiency and having a space-saving and relatively simple construction, also permits processing of workpieces comprising several flexible portions as well as of pre-assembled workpieces (which are provided with nuts, sleeves, or the like).

According to the invention, this is achieved by a bending machine comprising a working area for bending elongated workpieces, in particular wires, pipes, and the like, which are supplied by a supplying means, the bending machine comprising a base support including a front surface facing the supplying means as well as a rear surface turned away from the supplying means, wherein two bending robots are arranged on a common guideway centrally mounted to the base support in the working area such that they are displaceable parallel to the longitudinal direction of the base support. There are further provided, at the front surface of the base support—respectively viewed in the longitudinal direction of the base support—approximately in the middle, a holding clamp and, on either side of the latter, one auxiliary gripper each, which is displaceable in parallel with the bending robots. There is also provided, on the rear surface of the base support and also approximately in the middle, but laterally offset with respect to the holding clamp, a discharge gripper. The auxiliary grippers, the holding clamp and the discharge gripper are each pivotable to an inner pivoting position, in which they can hold or seize one workpiece each in the working area of the bending machine above the guideway and between both bending robots, and to an outer pivoting position, in which they are pivotable away from the base support, towards its outside, either to receive a workpiece from the magazine (auxiliary grippers and holding clamp) or to transfer the workpiece to a pick-up means (discharge gripper). Pivoting is effected in each case about a pivoting axis which is parallel to the longitudinal direction of the base support. The holding clamp, as well as the discharge gripper, are located immediately next to each other in their respective inner pivoting position, as viewed in the longitudinal direction of the base support.

The bending machine according to the disclosure has a central structure of the machine concept: all working units are attached to the central base support. By arranging the common guideway for both bending robots centrally on the base support and by arranging the gripping and holding clamp, provided laterally thereof, at the front and rear surface of the base support, it is possible to avoid interfering with the displacement of both bending robots in the working area, which are also centrally arranged on the base support, by the gripping means or the holding gripper arranged laterally thereof. The grippers can be moved completely independently of each other, and the auxiliary grippers can also be moved in parallel with the bending robots.

The bending machine according to the disclosure allows even long workpieces (approximately up to 6 m in length), such as lines, pipes, rods, wires, bars, flexible lines, etc., to be bent quickly and inexpensively. In this case, the workpieces fed by the feeding means are seized at least by the two auxiliary grippers, possibly also by the holding clamp, and then pivoted into the working area at the top of the base support, above the guideway for the bending robots. There, the workpiece can then be provided with bends from both of its end faces towards the middle by means of the two bending robots, which are designed such that they can be positioned as desired with respect to the workpiece and that they can bend the workpiece in any desired plane. After execution of the desired bending operations, the processed workpiece is then seized in the working area by the discharge gripper which has been pivoted into the working area. Then, the workpiece is released by the holding clamp and is then transferred to a subsequent pick-up means by pivoting the discharge gripper.

The bending machine according to the disclosure represents a fast working and flexibly employable manufacturing unit for bending the workpieces. In addition to processing long workpieces, shorter workpieces can also be bent and it is possible, for example, to bend two shorter workpieces at the same time. For this purpose, one workpiece each is held by one of the two auxiliary grippers on this side and by one of the central grippers (holding clamp or discharge gripper, respectively) in the working area between the bending robots and is then bent by one of the bending robots, starting from one side. Since the auxiliary grippers can be displaced and pivoted independently of each other, it is possible to work in a parallel or offset manner. In doing so, the bending robots enable bending at any desired positions of the workpiece, even in already bent areas of the workpiece.

With the machine according to the disclosure, it is also possible to use the bending heads additionally for transport or for other shaping or mounting functions. It is also possible to process pre-assembled workpieces, such as workpieces provided with nuts, sleeves, or the like, in which case the bending head pushes the nut or sleeve to the very end of the workpiece prior to the first bending operation.

In the machine according to the disclosure, the workpieces may be provided with up to three flexible portions. In this case, the grippers are positioned at suitable locations, thus allowing insurance of secure holding of the workpiece.

It is also possible to arrange several bending machines according to the disclosure next to each other, between the supplying means and the pick-up means, and to effect the transport or transfer, respectively, of the workpiece being processed in a bending machine, by a transfer from the discharge gripper of the machine, which has processed the workpiece, to the auxiliary grippers and, where applicable, to the holding clamp of the subsequent machine.

In the bending machine according to the disclosure, it is also possible to displace the workpieces via the displaceable auxiliary grippers along the workpiece's longitudinal axis (namely in the longitudinal direction of the bending machine) in the bending machine.

It is particularly advantageous, in the bending machine according to the disclosure, if all movements of the working units used and movable on said machine (auxiliary grippers, holding clamp, discharge gripper, bending robots) are controlled by a central program control.

In the bending machine according to the disclosure, the guideway preferably comprises two linear guides, arranged centrally at the top of the base support, which are parallel to each other in the longitudinal direction of the bending machine. This allows achievement of secure holding of the bending robots, while at the same time exactly guiding their movements during displacement in the longitudinal direction of the base support.

It is further advantageous if the auxiliary grippers in the bending machine according to the disclosure, are mounted to a linear guideway extending next to the guideway at the front surface of the bending machine, in the longitudinal direction of the bending machine, i.e. displaceable in the longitudinal direction of the bending machine.

Preferably, the holding clamp and the discharge gripper are further stationarily mounted in the longitudinal direction of the base support.

In the bending machine according to the disclosure, the auxiliary grippers, the holding clamp, the discharge gripper as well as both bending robots are further advantageously designed, in addition to their pivotability, such that they are displaceable in a radial direction relative to the respective pivoting axis.

A particularly preferable embodiment of the bending machine according to the disclosure can also be achieved in that the holding clamp is additionally designed as a rotary clamp, by means of which the picked-up workpiece can be rotated, such rotation advantageously allowing shortening the displacement movements of the bending robots in a very great number of cases.

In the bending machine according to the disclosure, the frame support preferably has assigned to it, at its front surface, a magazine as the supplying means, which magazine sequentially arranges the workpieces, aligned in parallel to each other and in the correct form for the auxiliary grippers to pick them up, in the supplying direction and provides them, sequentially arranged and in a synchronized manner, in a pick-up position for transfer to the bending machine, whereby a particularly quick manufacturing procedure can be achieved.

Advantageously, in the bending machine according to the disclosure, a pick-up means is further provided at the rear surface of the base support. The pick-up means comprises a support on which there are provided conveyor belts, aligned in parallel with an adjustable distance between them, for transporting the deposited, processed workpieces. By adjusting the distances between the conveyor belts, a flexible adaptation of the position of the conveyor belts according to the size and design of the workpiece to be processed can be achieved. The pick-up means may be provided with two or even more than two conveyor belts.

BRIEF DESCRIPTION OF THE DRAWINGS

The invention will be explained in more detail below, principally by way of example and more detailed description of the presently preferred exemplary embodiments of the invention, in conjunction with the accompanying drawings, of which:

FIGS. 5 and 6 show a perspective view (frontally, from top right) of a holding clamp of the bending machine according to the disclosure in two different positions of operation;

DETAILED DESCRIPTION

Figure 1:
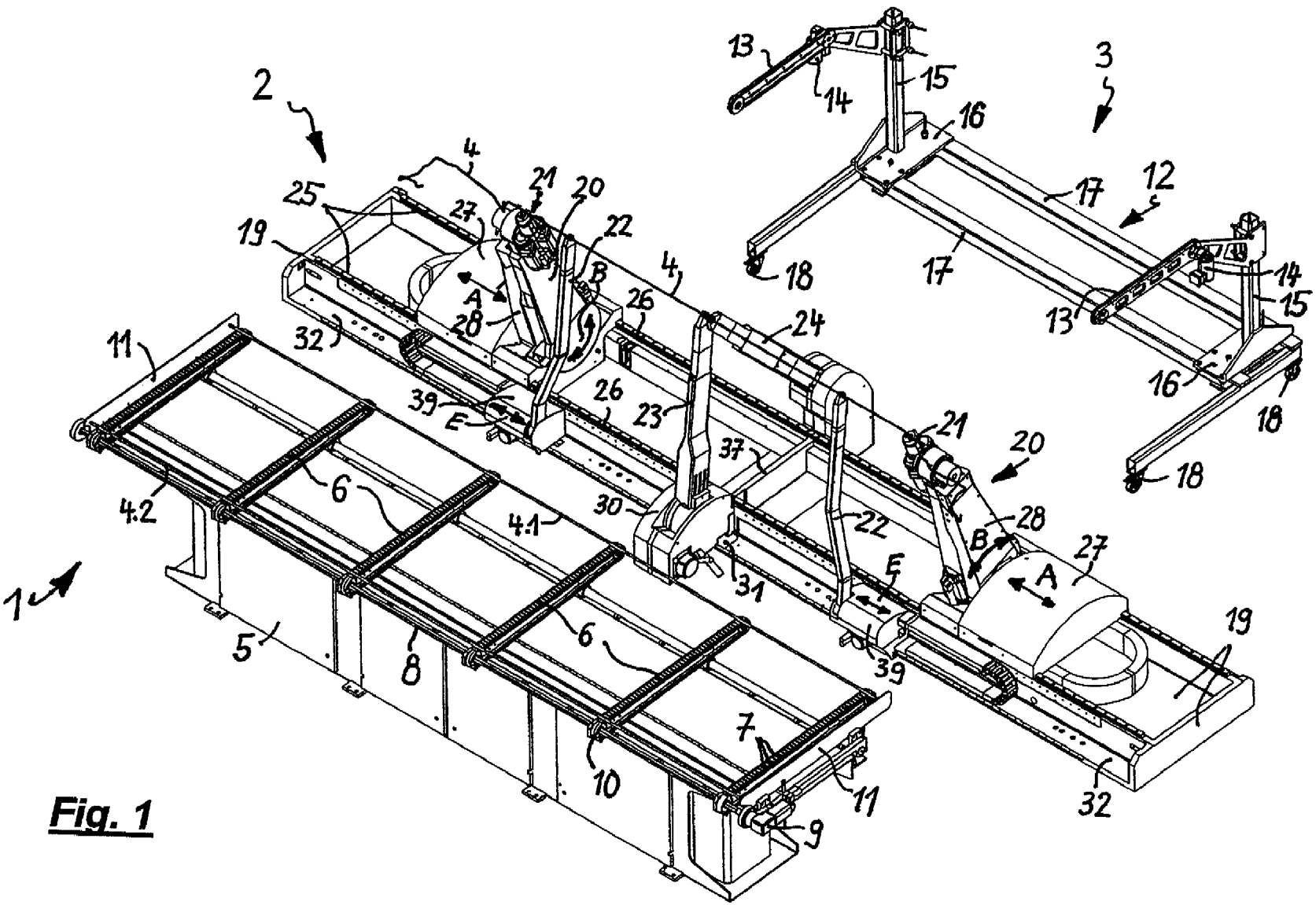
FIG. 1 shows a perspective view of an entire system, consisting of a bending machine with a supplying magazine and a discharge conveyor as a subsequently arranged pick-up means (viewing direction from top left)

FIG. 1 is a perspective top view of an entire system constituted by a magazine 1, a bending machine 2 and a pick-up means 3 in the form of a discharge conveyor.

The system allows bending of workpieces 4 in the form of, for example, rods, long lines, pipes, lines with flexible intermediate pieces (flexible lines), pre-assembled lines, etc.

In this case, the magazine 1 consists of several guiding conveyors 6, which are mounted to a frame 5 and each of which is provided—over its longitudinal direction—with wedge-shaped recesses 7 to allow transport of workpieces 4 of different diameters or widths, respectively. Via a shaft 8, a drive 9 drives pinion gears 10 fitted on said shaft 8, which in turn drive the guide belts 6. The drive 9 is controlled such that the workpieces 4 are conveyed to the pick-up area in a synchronized manner. In doing so, the workpieces 4 (for a better overview, only the workpiece 4.1, located at the front end of the pick-up area, and the workpiece 4.2 located at the rear end of said area are shown in the magazine by the representation of FIG. 1) are aligned by lateral guide plates 11 such that they are present in the correct orientation at the pick-up area for reception in the bending machine 2.

Next, the pick-up means 3 in the form of a discharge conveyor will be described:

The discharge conveyor 3 consists of a frame 12, to which the conveyor belts 13 are attached. In this case, a separate drive 14 is provided for each conveyor belt 13, so as to allow flexible adjustment of the spacing between the conveyor belts 13 according to the workpiece 4. For this purpose, the conveyor belts 13 are attached to vertical supports 15, each being in turn mounted to a carriage 16. The carriages 16 are displaceably fitted on guides 17 of the frame 12, which are mounted perpendicular to the conveying direction of the conveyor belts 13 and are parallel to each other, as can be seen in detail from FIG. 1.

Displacing the carriages 16 towards each other and away from each other allows adjustment of the spacing between the conveyor belts 13. Once adjustment has been effected, the carriages 16 are fixed on the guides 17 in a suitable manner.

The entire assembly of the discharge conveyor 3 is mounted on rollers 18, allowing to position the discharge conveyor 3 at any position relative to the bending machine 2.

In the representation of FIG. 1, the discharge conveyor 3 comprises two conveyor belts 13. However, it is also easily possible to provide more than two conveyor belts 13, depending on the design of the workpiece 4 to be picked up.

However, it should be noted that the magazine 1, as well as the discharge conveyor 3, may certainly also have a different suitable design, in which case the requirements of the bending machine 2 with respect to feed and discharge have to be met.

Figure 2:
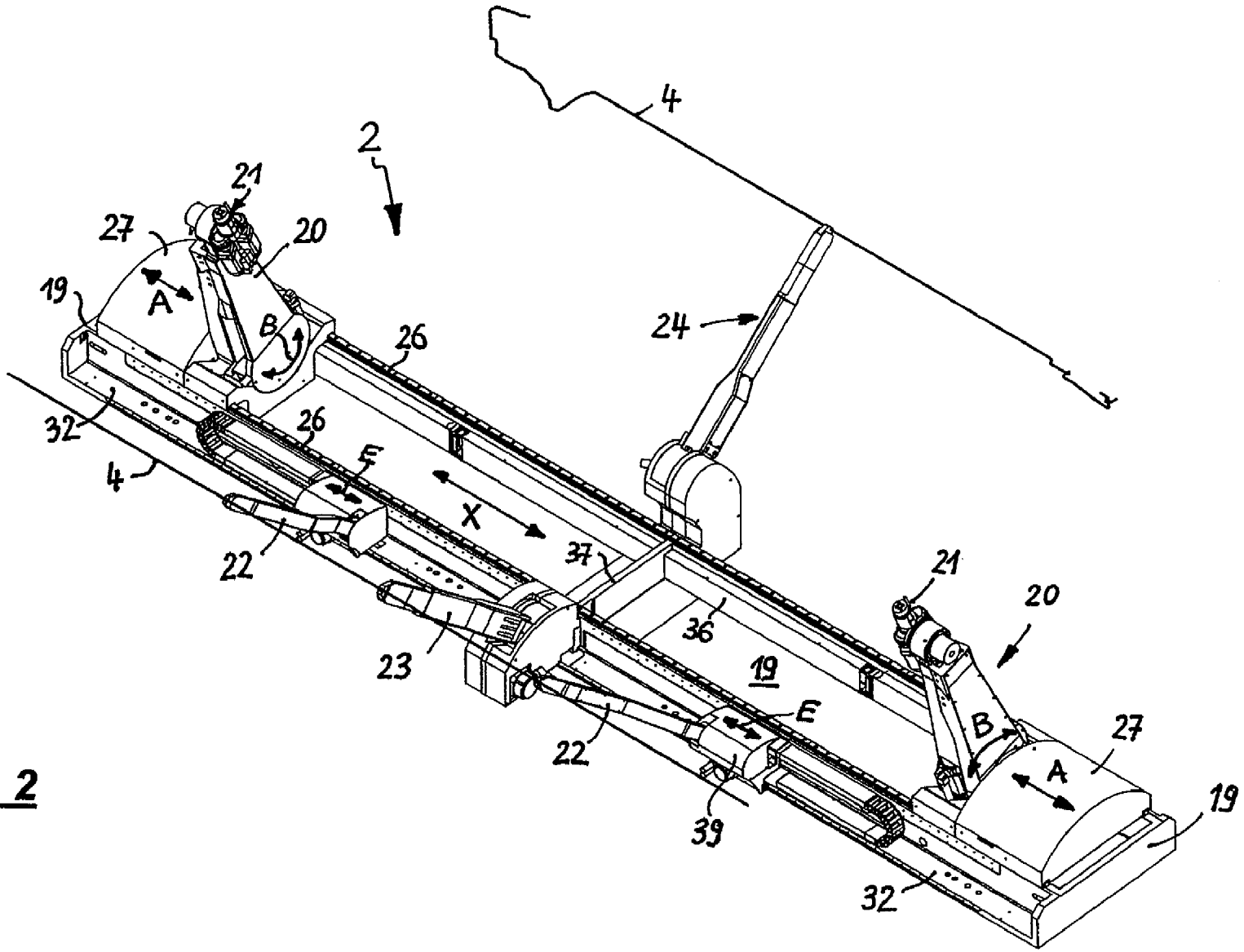
FIG. 2 shows a perspective top view (from top left) of a bending machine according to the disclosure while depositing a processed workpiece and picking up a new workpiece.

The bending machine 2 will now be described in detail:

For description of the bending machine 2, reference is made not only to the representation of FIG. 1 but, in particular, also to the representation of FIG. 2; the representations of both these Figures differ in that both Figures show the bending machine 2 in a different state of operation and FIG. 2 omits the magazine 1 and the discharge conveyor 3.

FIG. 1 shows the bending machine 2 in a state at the end of the bending operation performed by both bending robots 20 at both their end regions, while FIG. 2 represents the state in which the bending machine 2 has just picked up a new workpiece 4 from the magazine 1, while the workpiece to be processed has been pivoted to a position for transfer to the discharge conveyor 3.

The bending machine 2 consists of a base support 19, the two bending robots 20 with bending heads 21, two auxiliary grippers 22, holding clamp 23 as well as a discharge gripper 24.

The bending robots 20 are displaceably mounted on a guideway 25, which consists of two linear guides 26 extending in the longitudinal direction X of the base support 19 and parallel to each other, as indicated by corresponding arrow symbols on the bending robots 20 in FIGS. 1 and 2 (displacement direction A).

The two auxiliary grippers 22 and the holding clamp 23 are arranged at the front surface, facing the magazine 1, of the base support 19, whereas the discharge gripper 24 is attached to the opposite, rear surface of the base support 19, said rear surface facing the discharge conveyor 3.

Using this arrangement for the bending robots 20 and all grippers 22, 23 and 24 (since the holding clamp is principally provided also as a gripper), only one common guide bed, namely the base support 19, is needed. Due to this arrangement, no module presenting a contour that is a hindrance to the displacement of the bending robots 20 along the linear guides 26 is attached between the bending robots 20, so that both bending robots 20 can theoretically approach each other completely, generally without an unprocessable middle length existing in the middle of the workpiece to be processed.

Figure 4:
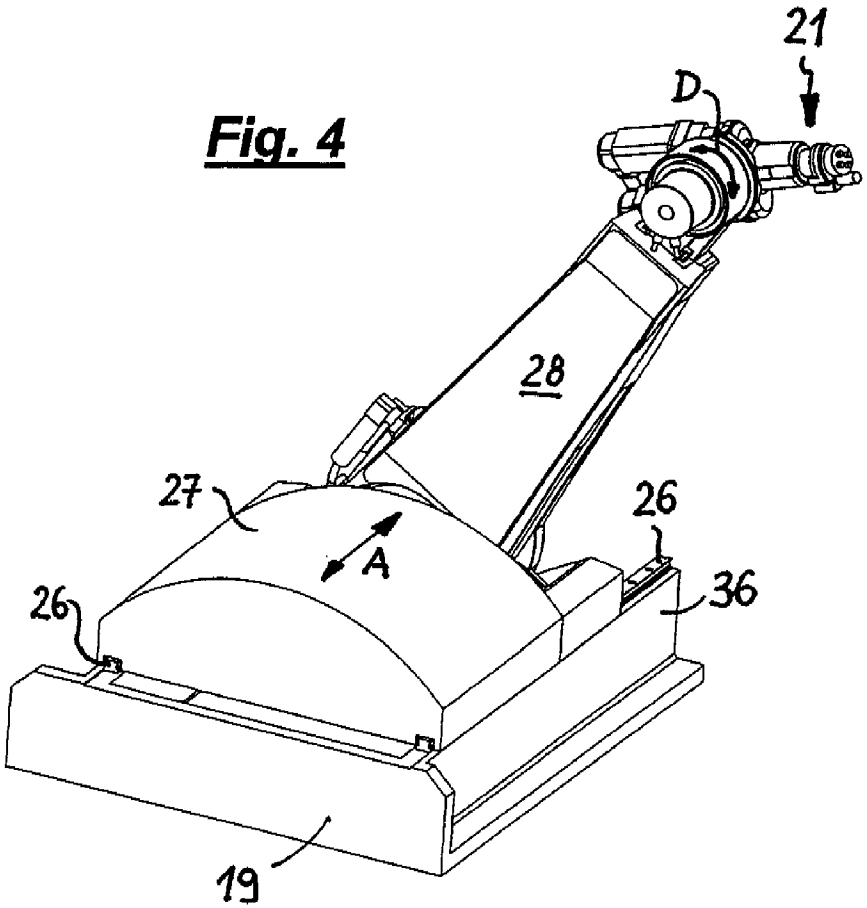
FIG. 4 shows the bending robot of FIG. 3 in a different perspective and in a different position of operation.
Figure 3:
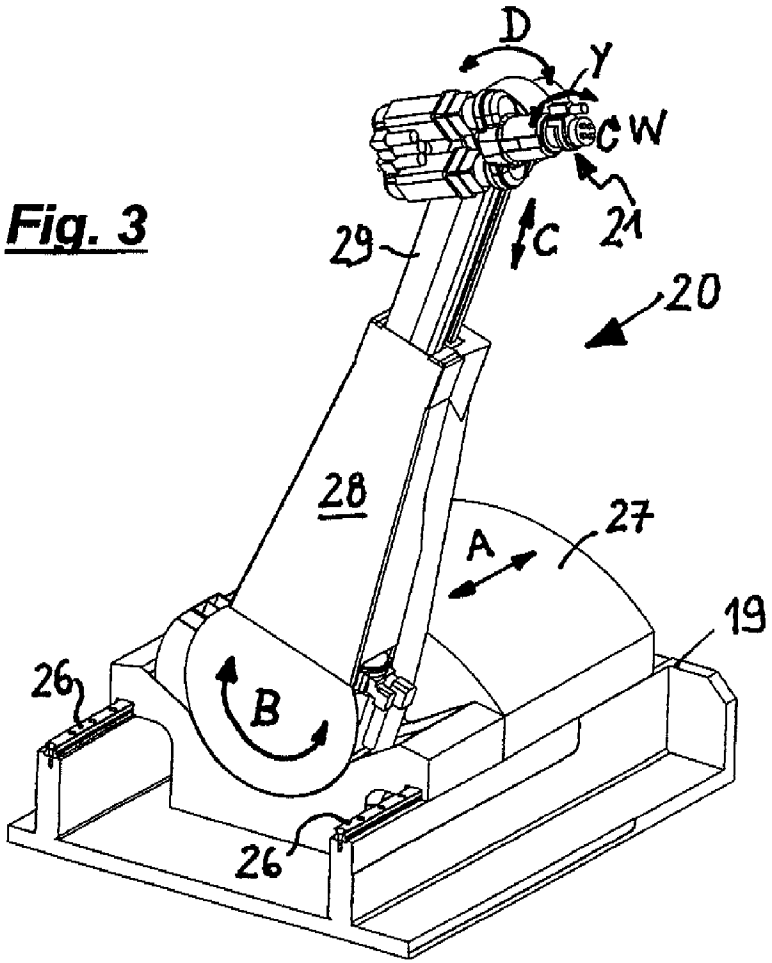
FIG. 3 shows a perspective view (laterally, from front right) of a bending robot of a bending machine according to the disclosure.

FIGS. 3 and 4 show perspective views of a bending robot 20, which FIG. 3 shows in a certain position of operation, viewed from the front surface of said robot, and which FIG. 4 shows in a somewhat different position of operation, viewed from the rear surface of said robot.

As FIGS. 3 and 4 show, each bending robot 20 comprises a carriage 27, which it can be displaced on the linear guides 26. Each bending robot 20 carries a bending head 21 of a known construction, including a bending mandrel and a bending pin, allowing carrying out different bending methods (draw bending, winding, roll bending, left/right bending, free form bending).

Each bending robot 20 can be moved, together with its carriage 27, on the linear guides 26 in the direction A, along the base support 19, for which purpose a suitable drive (not shown in the Figures) is employed.

Further, a pivoting arm 28 is attached to the carriage 27, said pivoting arm 28 being pivotable in the direction B about a pivoting axis which is parallel to the displacement direction A.

An arm 29 is mounted in the pivoting arm 28 so as to be radially extendable and retractable (displacement direction C) with respect to the pivoting axis for the pivoting movement B, said arm 29 allowing the bending head 21 to be positioned radially with respect to said pivoting axis. The bending head 21 is articulated to the end of the arm 29 so as to be rotatable about an axis of rotation in the pivoting direction D, said axis of rotation being parallel to the pivoting axis pivoting direction B) and parallel to the displacement direction A of the carriage 27 (and, thus, to the direction of the linear guide 26).

The bending head 21 shown in FIGS. 3 and 4 comprises two driving axles for carrying out rotary movements W (of the bending mandrel) and Y (of the bending finger), as is evident from FIGS. 3 and 4. Due to the three directions of movement, namely the pivoting direction B, the direction of linear movement C, which extends radially to the pivoting direction B, and the rotary direction D of the bending head 21, as well as due to the displaceability along the axis of displacement A, it is possible to position the bending head 21 in any position and at any location at or relative to the workpiece 4.

Now, FIGS. 5 and 6 show, in an enlarged perspective view, the design of the gripper which forms the holding clamp 23 and is directed vertically upwards in the representation of FIG. 5, whereas it is rotated to its outer pivoting position (for receiving a workpiece 4, e.g. from the magazine 1, or the like) in FIG. 6. The holding clamp 23 is pivotably supported in a base 30, via which they are supported on a recess 31 in the top surface of a linear guideway 32 at the front surface of the base support 19. The base 30 is stationarily attached to the base support 19, namely—as FIGS. 1 and 2 show—approximately in the middle of said base support 19.

The holding clamp 23 is pivotable—about an axis of rotation, which is located within the base 30 and is arranged in parallel with the orientation of the linear guides 26—such that the holding clamp 23 can execute a pivoting movement H. Moreover, the head part 33 of the holding clamp 23 can also be displaced in a direction J located radially with respect to the axis of rotation of the holding clamp 23.

At their protruding end, the holding clamp 23 comprise two gripping jaws 34, which are shown in their opened state in FIG. 5 and in their closed state in FIG. 6. Using these gripping jaws 34, the workpiece 4 can be seized at its central region and is fixed there during bending.

If necessary, the holding clamp 23 can also be used, in the case of long workpieces 4, for transporting the respective workpiece 4 from the magazine 1 to the working area (bending area) of the bending machine 2.

Figure 7:
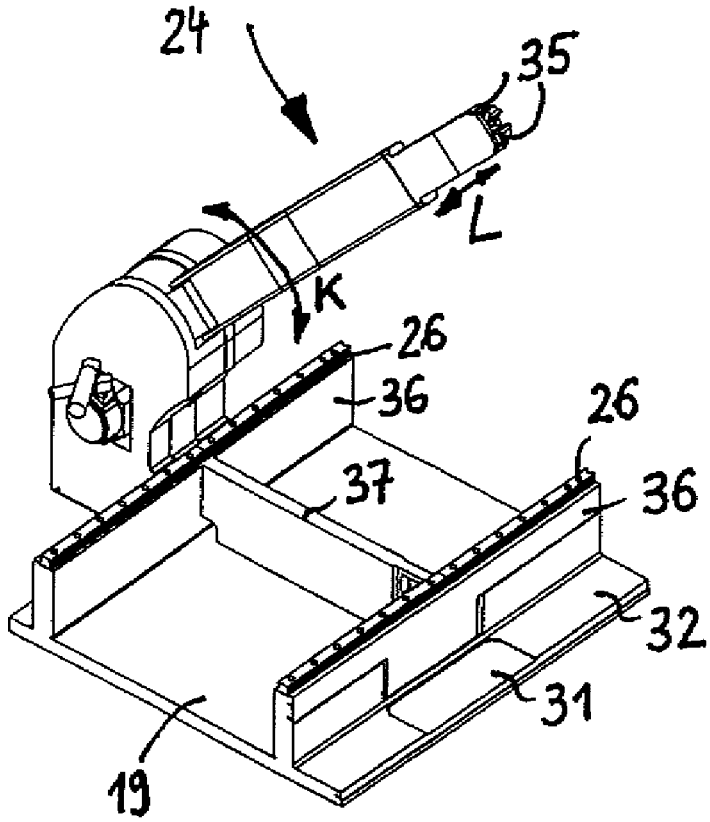
FIGS. 7 and 8 show a perspective view (frontally, from top right) of a discharge gripper of the bending machine according to the disclosure in two different positions of operation.
Figure 8:
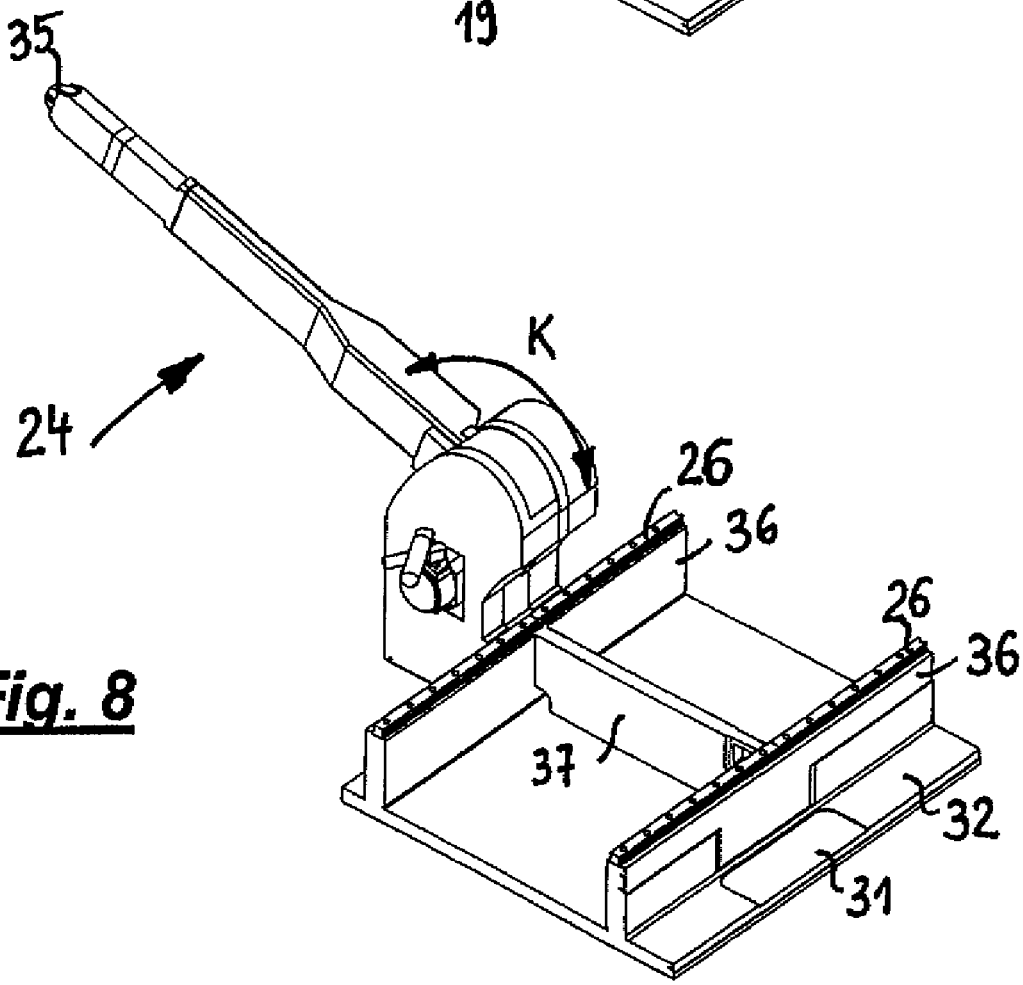

FIGS. 7 and 8 show the discharge gripper 24, with FIG. 7 showing it in its inner pivoting position, in which it is pivoted into the working area (bending area) of the bending machine 2 via linear guides 26 so as to receive a workpiece 4 located and processed there.

The construction of the discharge gripper 24 is practically identical with that of the holding clamp 23 already described above.

As also shown in FIGS. 1 and 2, the discharge gripper 24 is likewise attached approximately centrally to the base support 19 in a likewise stationary manner, but in such a way that—as is clearly visible in FIG. 1—the gripping jaws 35 of the discharge gripper 24 have a slight lateral offset, as viewed in the longitudinal direction of the base support 19, with respect to the position of the gripping jaws 34 of the holding clamp 23, when both grippers 23, 24 are located at their inner pivoting position, i.e. when both grippers have been pivoted into the working area of the bending machine 2 so as to seize or hold a workpiece 4 located there, as shown in FIG. 1. The lateral offset of the holding clamp 23 and of the discharge gripper 24 is selected such that—as also clearly shown in FIG. 1—a workpiece 4 present in the working area of the bending machine 2 can be seized by the gripping jaws 34 of the holding clamp 23 and by the gripping jaws 35 of the discharge gripper 24 in immediately adjacent areas, so that simultaneous gripping by both grippers is possible.

The discharge gripper 24 is pivotable in a pivoting direction K about a pivoting axis extending in parallel with the linear guides 26 and is also displaceable, like the holding clamp 23 (see the above description), in a radial direction L with respect to said pivoting axis. The gripping unit of the discharge gripper 24 comprising two gripping jaws 35, which can be opened, or closed to seize a workpiece 4, has a design which is identical to that of the holding clamp 23.

At the end of the bending process, the workpiece 4, which is still being held by the holding clamp 23, is seized by the discharge gripper 24 in the working area of the bending machine 2, then released by the holding clamp 23 and subsequently deposited on the discharge conveyor 3 by pivoting in the pivoting direction K.

As is evident from all Figures described so far, both linear guides 26 on which the two bending robots 20 are displaceable in the longitudinal direction of the base support 19 are respectively mounted to a longitudinal ledge 36 of the base support 19, as the associated supporting and bearing body.

As is evident from FIGS. 1 and 2, as well as, in particular, FIGS. 7 and 8, a cross brace 37 is provided at a longitudinal position of the base support 19, where the holding clamp 23 and the discharge gripper 24 are stationarily mounted respectively to the front and rear surfaces of said base support 19, between the two longitudinal ledges 36 of the base support 19, for rigidifiecation in this place.

Figure 9:
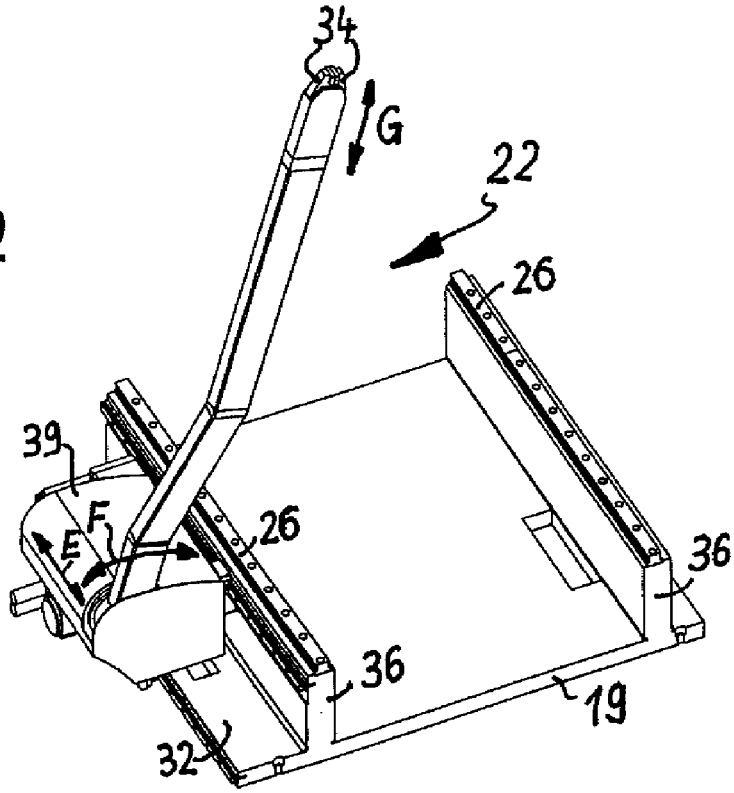
FIG. 9 shows a perspective top view (from top right) of an auxiliary gripper of the bending machine according to the disclosure, in the inner pivotal position of said gripper, and, below it.
Figure 10:
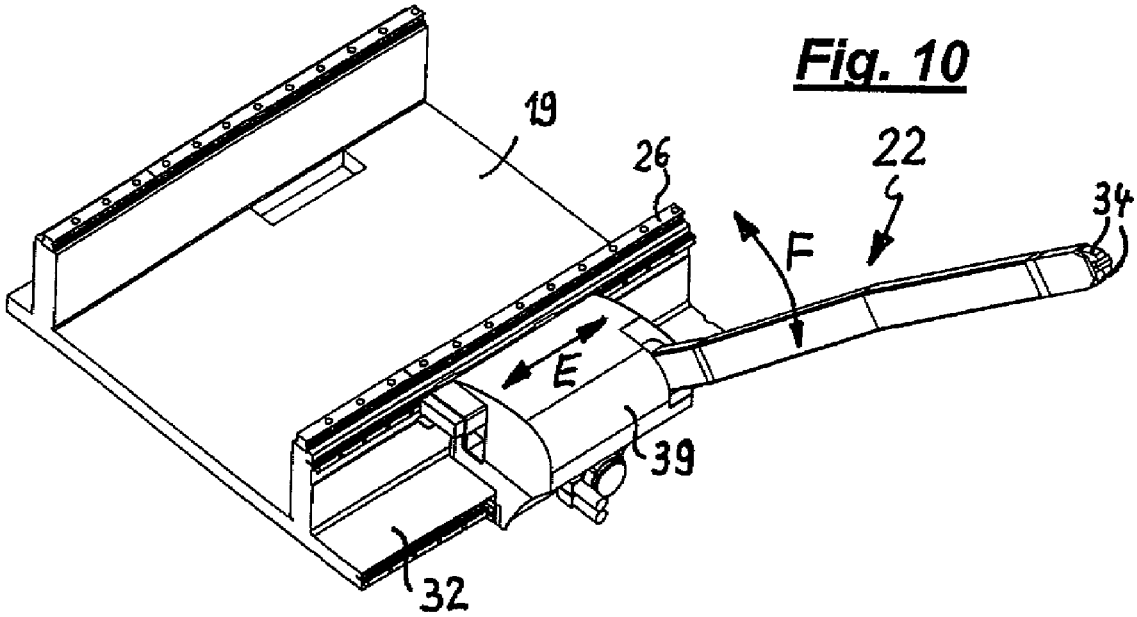
FIG. 10 shows the auxiliary gripper of FIG. 9 in a different perspective view and in a different position of operation (here, in its outer pivotal position).

Finally, reference is made also to FIGS. 9 and 10, wherein an auxiliary gripper 22 is shown in a perspective view from above, but in two different perspective positions. The constructive design of the auxiliary gripper 22 corresponds completely to that of the two gripping units of holding clamp 23 and/or discharge gripper 24, and reference is made to their above description.

Each discharge gripper 22 is pivotably held in a carriage 39, by which it is displaceable in the direction E along the linear guideway 32, which extends outwardly away from the front surface of the base support 19 at right angles.

Each auxiliary gripper 22 is again not only displaceable in the direction E (along the linear guideway 32) and pivotable in the pivoting direction F, but is also designed to be extendable and retractable also in its protruding end region in the direction G, radially to its pivoting axis.

Due to the pivoting movement F and the linear movement G, the auxiliary gripper 22 is provided for transporting and supporting a workpiece 4 and can be optimally positioned relative to the workpiece 4 in each case. The pivoting movement F enables removal of the workpiece 4 from the magazine 1 and positioning of the workpiece 4 in the working area of the bending machine 2. Both auxiliary grippers 22 can move along the workpiece 4 together with the bending robots 20 during bending, whereby the workpiece 4 is additionally stabilized. When bending of the workpiece 4 is almost complete, so that the bending robots 20 are already near the center of the workpiece 4, the auxiliary grippers 22 can pivot away and seize a new workpiece 4 in the magazine 1, while the bending robots 20 finish bending the workpiece 4 already present in the working area and still being held there by the holding clamp 23.

The functioning of the bending machine 2 will be described now:

Initially, the workpieces 4 are already aligned in the magazine 1 in parallel and in sequence and are conveyed in a synchronized manner to the pick-up position which the workpiece 4.1 has assumed in the representation of FIG. 1.

In the pick-up position, the auxiliary grippers 22, and possibly also the holding clamp 23 with their gripping jaws 34, seize the workpiece 4, as shown in the representation of FIG. 2.

The workpiece 4 is then transferred to the working area of the bending machine 2 at the center of the base support 19, above the linear guides 26, by a common pivoting movement of the auxiliary grippers 22 in the direction F and of the holding clamp 23 in the direction H by the gripping means which have seized the workpiece 4. The use of auxiliary grippers 22 is necessary especially in the case of long workpieces 4 in order to safely guide the long workpiece to be picked up and to prevent undesired vibrations thereof. The auxiliary grippers 22 and the holding clamp 23 also allow the bending of workpieces 4 comprising elastic intermediate pieces.

Next, at each of the two end regions of the long workpiece 4, the bending head 21 of the corresponding bending robot 20 present there is centered on the workpiece 4 in the working area of the bending machine 2. In the further working process, the workpiece 4 generally remains positioned between the bending mandrel and the bending pin of the bending head 21. Due to the movement of the bending robots 20 with the axes A, B, C and D, the bending head 21 is respectively moved on the workpiece 4 from the end of the workpiece to its center. At the same time, the bending head 21 is rotated about the axis of the workpiece 4 and the workpiece 4 is provided with bends at the corresponding locations. Towards the end of the bending process, the workpiece 4 is seized by the discharge gripper 24, after which the auxiliary grippers 22 as well as the holding clamp 23 releases the workpiece 4 and pivot back to the magazine 1. After completion of the last bending operation, the bending heads 21 of the bending robots 20 are disengaged again and the robots 20 are moved back to their respective outer end positions. In the meantime, the discharge gripper 24 deposits the workpiece 4 on the discharge conveyor 3 by a pivoting movement in the pivoting direction K. As soon as the workpiece 4 has been removed from the working area of the bending machine 2, a new workpiece 4 can be pivoted in, and the bending process can be started anew.

However, it is also possible for the bending machine 2 to bend two shorter workpieces 4 instead of one longer workpiece 4. For this purpose, one shorter workpiece 4 is respectively held by an auxiliary gripper 22 and by one of the central grippers (holding clamp 23 or discharge gripper 24) in the working area of the machine and is bent starting from one end face. The pick-up of the shorter workpiece from the magazine 1 and the transfer into the working area of the bending machine 2 is effected in this case by an auxiliary gripper 22 and by the holding clamp 23; in this case, a correction of the longitudinal position of the picked-up workpiece 4 is also effected by suitable displacement of the auxiliary gripper 22 in the direction E, with the discharge gripper 24 pivoted inwardly, and its gripping jaws 35, although already placed in contact around the existing workpiece 4, but not yet closed, being positioned exactly such that a second workpiece can be subsequently introduced into the working area as well, longitudinally aligned with respect to the workpiece 4 already present there, by means of the holding clamp 23 and the other auxiliary gripper 22. However, it is also possible here to provide both the holding clamp 23 as well as the discharge gripper 24 such that they are no longer stationary on the base support 19, but are also displaceable in the longitudinal direction of the latter.

The auxiliary grippers 22 can be displaced and pivoted independently of each other, so that parallel or offset operation is possible at any time.

The bending robots 20 allow bending at any position of the workpiece, even in already bent areas. If the holding clamp 23 is simultaneously also designed as a rotary clamp, there is also the favorable possibility to shorten the displacement movements of the robots 20, where applicable, by rotating the workpiece 4 held by the clamp in the working area of the bending machine 2, which further increases the efficiency of the bending machine 2.

All movements of the bending robots 20 and of the various grippers 22, 23 and 24 are centrally controlled by a program control not shown in the Figures.

The bending robots 20 can also be provided such that they can be further used also to pick up the workpiece 4 from the magazine 1 and to deposit the processed workpiece on the discharge conveyor 3.

Furthermore, still further, additional auxiliary grippers 22 and/or discharge grippers 24 may be attached to the front and rear surfaces of the base support 19 in the bending machine 2 according to the invention. This will even allow processing of workpieces 4 having more than three flexible portions (this embodiment is not shown in the Figures).

We claim:

1. A bending machine having a working area for bending elongated workpieces, the bending maching comprising:

a base support comprising a top surface, a front surface, and a rear surface, wherein the front surface faces a supply means;

a guideway mounted longitudinally on the top surface of the base support;

two bending robots in communication with the guideway wherein the robots are displaceable along the guideway;

a holding clamp mounted on the front surface of the base support;

at least one auxiliary gripper, wherein the auxiliary gripper is positioned proximate the holding clamp and is in displaceable mounted communication with a linear guideway, the linear guideway extending outwardly at right angles away from the front surface of the base support; and at least one discharge gripper mounted on the rear surface of the base support and laterally offset with respect to the holding clamp.

2. The bending machine of claim 1, wherein the working area is positioned above the guideway.

3. The bending machine of claim 1 comprising a plurality of auxiliary grippers, wherein the auxiliary grippers are positioned on either side of the holding clamp.

4. The bending machine of claim 3, wherein the auxiliary grippers, the holding clamp and the discharge gripper are each pivitable to an inner position in the working area and to an outer position extending away from the front or rear face of the base support, respectively.

5. The bending machine of claim 4 wherein the auxiliary grippers and/or the holding clamp is adapted to receive a workpiece from the supply means.

6. The bending machine of claim 4, wherein the discharge gripper is adapted to transfer a workpiece to a pick-up means.

7. The bending machine of claim 1, wherein the auxiliary grippers, the holding clamp and the discharge gripper pivot about an axis parallel to the guideway.

8. The bending machine of claim 3, wherein movement of the bending robots, the auxiliary grippers, the holding clamp and the discharge gripper is controlled by a central control program.

9. The bending machine of claim 1, wherein the guideway comprises two linear guides parallel to each other in the longitudinal direction of the support base.

10. The bending machine of claim 1, wherein the holding clamp and the discharge gripper are stationarily mounted in the longitudinal direction of the base support.

11. The bending machine of claim 3, wherein the auxiliary grippers, the holding clamp, the discharge gripper and the bending robots are displaceable extending radially relative to a respective pivoting axis.

12. The bending machine of claim 1, wherein the supply means is positioned proximate the front surface of the base support, and wherein the supply means provides workpieces aligned in parallel to each other, sequentially arranged in a supply direction and in a pick-up position for synchronized transfer to the work area.

13. The bending machine of claim 12, wherein the supply means is a magazine.

14. The bending machine of claim 1, wherein a pick-up means is positioned at the rear surface of the base support and comprises a support and a plurality of conveyor belts wherein the conveyor belts are aligned in parallel on the support with an adjustable distance between the conveyor belts, for transporting processed workpieces.

15. The bending machine of claim 14, wherein the holding clamp is a rotary clamp adapted to rotate picked-up workpieces.

16. The bending machine of claim 1 wherein the holding clamp and the discharge gripper are displaceable in the longitudinal direction of the support base.

* * * * *